United States Patent [19]

McCaughey

[11] 3,997,955

[45] Dec. 21, 1976

[54] APPARATUS FOR TERMINATING A PLURALITY OF INSULATED CONDUCTORS IN RESPECTIVE INSULATION-PIERCING CONTACTS OF AN ELECTRICAL CONNECTOR

[75] Inventor: William Stephen McCaughey, Oak Brook, Ill.

[73] Assignee: Bunker Ramo Corporation, Oak Brook, Ill.

[22] Filed: Feb. 14, 1974

[21] Appl. No.: 442,459

Related U.S. Application Data

[63] Continuation-in-part of Ser. No. 407,780, Oct. 19, 1973, abandoned.

[52] U.S. Cl. ..... 29/203 HT; 29/203 MW

[51] Int. Cl.[2] ..... H01R 43/04

[58] Field of Search .... 29/203 HT, 203 H, 203 DT, 29/203 MW, 203 P, 628

[56] References Cited

UNITED STATES PATENTS

| | | | |
|---|---|---|---|
| 3,742,571 | 7/1973 | Brehm | 29/203 HT |
| 3,758,935 | 9/1973 | Long et al. | 29/203 HT |
| 3,800,390 | 4/1974 | Johnston | 29/203 MW |
| 3,859,724 | 1/1975 | Folkenroth | 29/203 MW |
| 3,866,293 | 2/1975 | Nijman | 29/203 MW |

*Primary Examiner*—Carl E. Hall
*Attorney, Agent, or Firm*—F. M. Arbuckle; William Lohff

[57] ABSTRACT

A plurality of insulated conductors, for example in the form of a cable, are terminated in respective insulation-piercing portions of contacts which are disposed in separate aligned spaced channels of an electrical connector through the utilizaton of apparatus which is adapted for separation and guidance of the conductors and cooperating apparatus for simultaneously inserting all of the insulated conductors in their respective insulation-piercing contacts. A stationary work station is provided and the conductor cutting mechanism and the conductor insertion mechanism are pivotally mounted for rotation to the work station. A conductor separation and clamping device has the conductors inserted therein before attachment to the termination apparatus providing that conductor identification and positioning may be performed at one location and that the conductors may be transported to a work station in a separated relationship. With this structure, the conductors may be cut to the proper length at the separate location to eliminate the cutting operation at the work station. In this event, only the insertion operation is performed at the work station. Another device, which may also function to separate and hold the conductors for transport, is constructed to engage and become a part of an assembled, wired connector so as to adapt one connector construction to machines designed to terminate another connector construction.

12 Claims, 15 Drawing Figures

FIG. 1
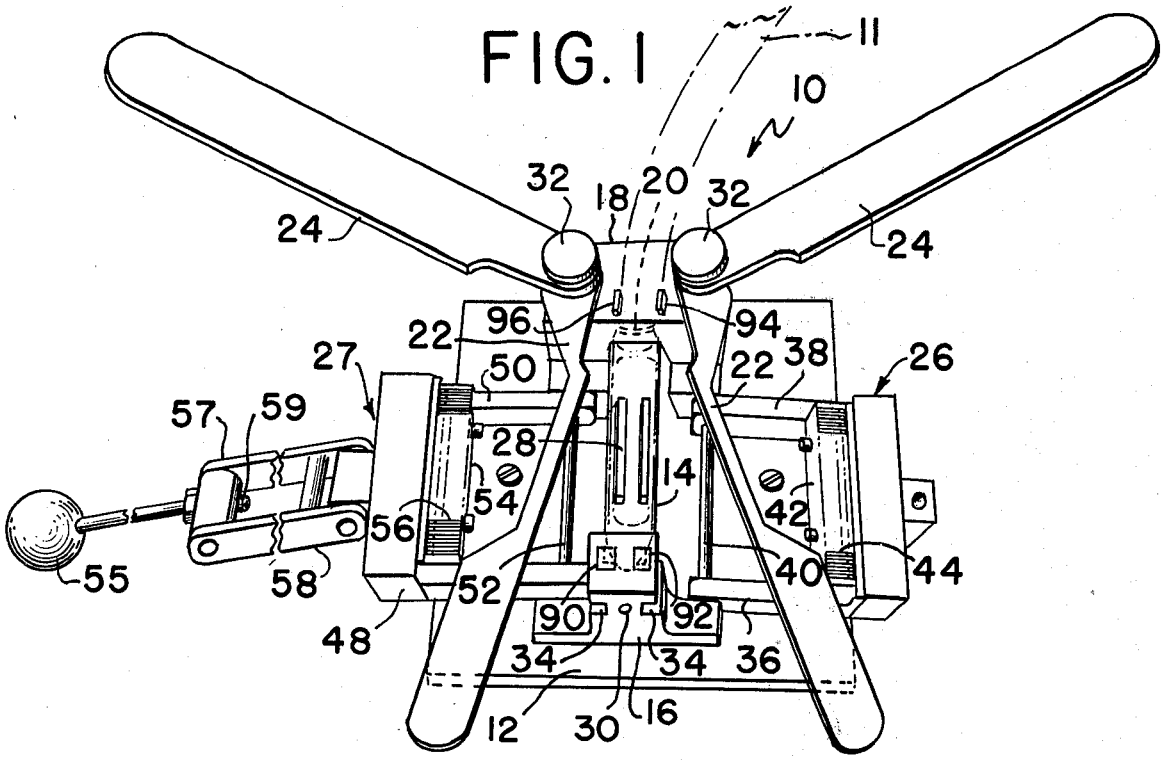
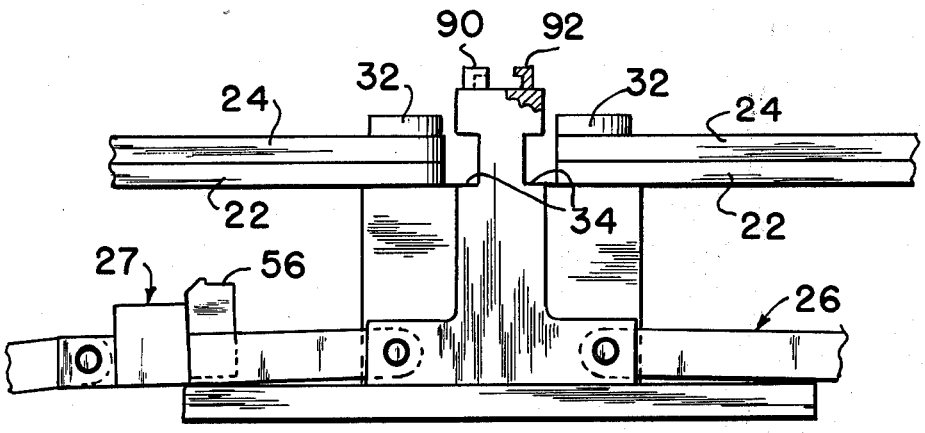
FIG. 2

APPARATUS FOR TERMINATING A PLURALITY OF INSULATED CONDUCTORS IN RESPECTIVE INSULATION-PIERCING CONTACTS OF AN ELECTRICAL CONNECTOR

CROSS REFERENCE TO RELATED APPLICATION

This application is a continuation-in-part of my application Ser. No. 407,780, filed Oct. 19, 1973 now abandoned.

BACKGROUND OF THE INVENTION

1. Field of the Invention

This invention relates to techniques for simultaneously inserting a plurality of insulated conductors in respective insulation-piercing contacts of an electrical connector, and more particularly to techniques for handling insulated conductors prior to and during insertion, including transporting, separating, cutting and positioning and aligning conductors with respect to respective insulation-piercing contacts of an electrical connector.

2. Description of the Prior Art

The termination of insulated conductors in insulation-piercing contacts is generally well known in the art and covers a wide variety of techniques including the grasping of conductors between the fingers and forcing the same between coplanar slightly spaced tines, for example, of a terminal, and machine insertion of one or a plurality of conductors into respective insulation-piercing portions of contacts. The prior art has, however, failed to provide a simple, yet effective, technique and corresponding apparatus for handling the conductors prior to insertion, handling being here intended to include a variety of operations such as separating and guiding of conductors, transporting of conductors in a spaced relationship, cutting of the conductors and alignment of the conductors with respect to connector channels having insulation-piercing contacts therein, and the attendant scheduling and cooperation of such functions to attain a terminated conductor in a simple and economical manner.

Apparatus has been constructed which does provide for the separation or fanning of conductors for splicing and for disposition relative terminal apparatus. Yet, this structure is either complex in nature, or not easily adapted to continuous termination operations on a mass scale.

SUMMARY OF THE INVENTION

It is a pri[illegible] of the present invention to provide termination techniques including method and apparatus for simultaneously terminating a plurality of insulated electrical conductors in respective insulation-piercing contacts of an electrical connector wherein the conductors are simply and easily handled with respect to transporting, separating, routing, cutting and aligning the conductors with respect to channels of an electrical connector which have the contacts disposed therein.

Another object of the invention is to provide a method and apparatus for adapting one connector construction to termination apparatus designed for another connector construction.

These and other objects are realized through the provision of apparatus and attendant procedures which may employ combinations of the aforementioned operations. The invention is realized in an embodiment wherein a connector supporting structure is fixedly mounted with respect to a base and a conductor supporting structure is mounted above the connector supporting structure. In this embodiment, a first cutting member is rotated to a position parallel to the connector and slightly above the lower ends of the individual channels. With the conductors vertically disposed along side the respective grooves and draped over the first cutting member, a second cutting member is rotated to cooperate with the first cutting member to sever the conductors. The conductor insertion members, in this embodiment, are carried on a mechanism which is rotated to each side of the connector for forcing the conductors into respective contacts.

In another embodiment of the invention the first cutting member is fixed parallel to the connector and the second cutting member is rotated to cooperate with the first cutting member to sever the conductors.

The conductor supporting structure is separable from the rest of the apparatus and comprises a comb-like structure having a slot extending through the comb teeth for receiving a conductor separation and spacing member. For positioning conductors along a pair of spaced parallel channels on each side of a connector the comb teeth have a depth greater than the desired conductor separation and receive two conductors therebetween. The width of the separation and spacing member is dimensioned approximately the desired spacing between two rows of conductors, i.e. the width of the connector, and disposed between the conductors to prevent them from being displaced toward each other. The separation and spacing member is also a part of a conductor clamping mechanism which includes a wire having a slidable pivotal connection at one end of the separation member and a releasably engageable hook for connection to the other end of the separation member as the wire embraces the conductors positioned on the side of the outermost portions of the comb teeth.

A second embodiment of a conductor supporting structure adapts a connector of one construction for termination by apparatus designed for a different connector construction. This structure, hereinafter called an "adapter" engages the connector by means of a complementary ridge and slot mechanism and is designed to be a permanent part of the terminated connector. As will be evident from the detailed description of the adapter, it may be used alone or in connection with the above-described conductor supporting structure.

The conductor supporting structures provide several advantages. First of all, the conductors can be separated and held therein at a location adjacent or remote from the work station, which ever may be more advantageous in connection with the particular overall assembly process. Secondly, the conductors may be cut to the appropriate length at such different locations, thereby obviating the necessity for cutting the conductors at work stations. In addition, when it is more desirable to separate and hold the conductors at a different location, the conductors may be easily transported in a separated, spaced relationship to the work station.

In another embodiment of the invention the connector supporting structure includes a pair of spaced combs and a connector alignment stop for positioning the connector so that its contact channels are aligned with the slots between the comb teeth. The supported conductors dress into the combs and are cut during insertion by an edge on the individual insertion members and the rear edge of the slots between the comb teeth.

BRIEF DESCRIPTION OF THE DRAWINGS

Other objects, features and advantages of the invention, its organization, construction and operation will be best understood from the following detailed description of a preferred embodiment of the invention taken in conjunction with the accompanying drawings, on which:

FIG. 1 is a plan view of a first embodiment of the invention with a stationary connector supporting structure, a detachably mounted conductor supporting structure, a rotatable cutting mechanism for cutting the conductors, and an insertion mechanism is rotatably mounted for rotation to an insertion position;

FIG. 2 is an elevational view of the apparatus of FIG. 1;

DESCRIPTION OF THE PREFERRED EMBODIMENTS

Figure 3:
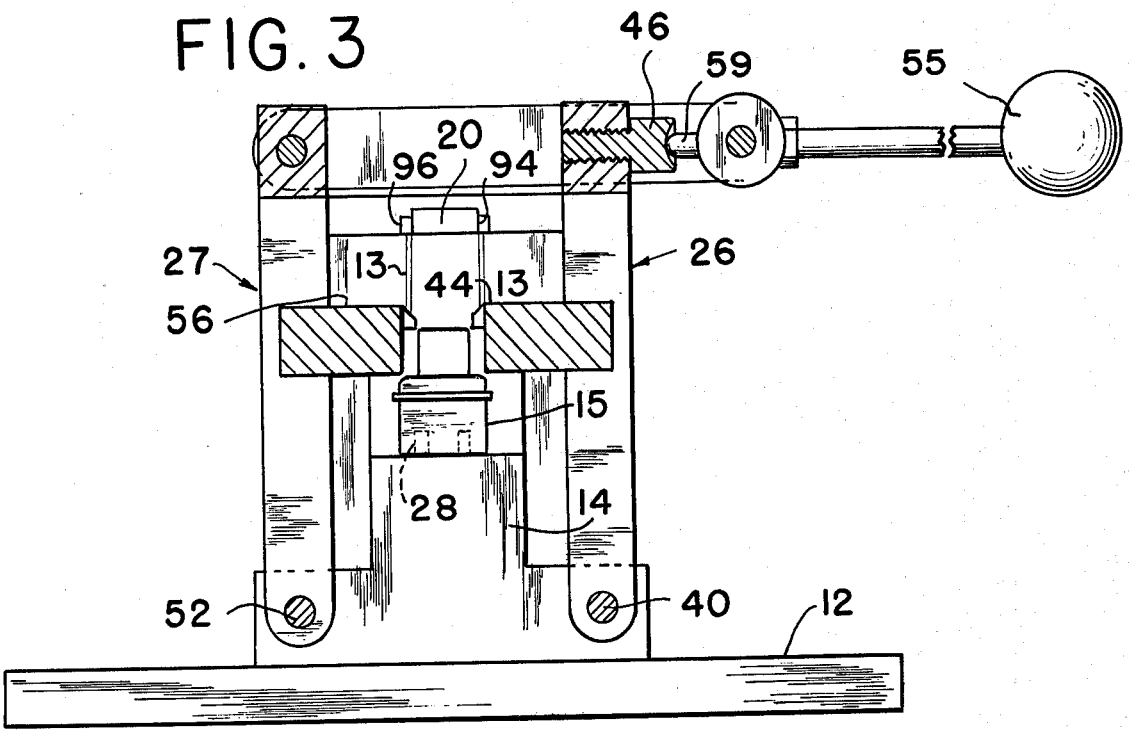
FIG. 3 is a sectional view of the apparatus of FIG. 1 taken generally along the line III—III.

Referring to FIGS. 1-3, a terminating apparatus 10 is illustrated for terminating the individual conductors 13 of a cable 11 in insulation piercing contacts disposed in respective channels 17 of an electrical connector 15. The apparatus 10 generally comprises a base 12, a connector support 14 mounted on the base 12, and a conductor support mounted on the base 12 which includes a front support member 16, a rear support member 18 and a conductor holder 20 connected to the front and rear support members 16 and 18 for holding the conductors 13 in a spaced relationship corresponding to the spacing of the connector channel 17.

The apparatus illustrated in FIGS. 1–3 is symmetrical with respect to each side of the connector 15; therefore, equivalent structure has been given the same reference characters. On each side of the apparatus 10 there is provided a first cutting arm 22 and a second cutting arm 24 which are rotatably carried on the rear support member 18 for rotation about an axis defined by a pin 32 to a location parallel to and adjacent the connector 15. The front support member 16 is provided with a recess 34 for receiving the distal ends of the cutting arms 22, 24 in the position parallel to the connector 15. Therefore, in this embodiment of the invention the cutting arms 22 and 24 are rotatable in hotizontal planes which, as will be appreciated from the description below, lie perpendicular to the direction of movement of the insertion mechanism parts 26 and 27.

The connector is positioned between a pair of guide members 28 carried on the connector support 14 and has its end in abutment with an adjustable screw 30 for proper alignment and positioning.

The apparatus 10 is provided with an insertion mechanism which comprises a pair of cooperable parts 26 and 27. The insertion mechanism part 26 includes a pair of spaced arms 36, 38 which are pivotally carried on a pin 40 between the front and rear support members 16 and 18. The free ends of the arms 36 and 38 have an insertion tool 42 connected therebetween including a plurality of insertion blades 44 which are aligned with the individual conductors 13 and channels 17. The insertion mechanism part 26 further includes a projection 46 which is part of a toggle mechanism which will be dicussed in detail below.

The insertion mechanism 27 is constructed quite similar to the part 26 and comprises a pair of spaced arms 48 and 50 which are carried for rotation between the front and rear support members 16 and 18 by a pin 52. An insertion tool 54 having a plurality of insertion members or blades 56 is carried between the spaced arms 48 and 50. A cam pin 59 is connected between another pair of spaced arms 57 and 58 which are pivotally connected to the insertion tool 54. This structure also forms a part of the toggle mechanism wherein the insertion mechanism parts 26 and 27 are rotated toward each other to a position for conductor insertion, the spaced arms 57 and 58 receive the projection 46 therein with the cam pin 59 against the outer surface of the projection and a downward pressure is applied to the handle 55 to force the parts 26 and 27 toward each other. (FIG. 3)

Figure 4:
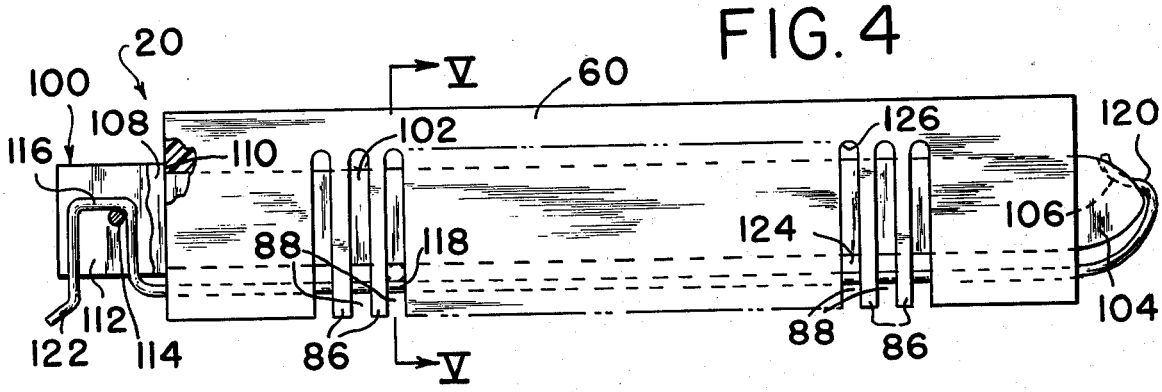
FIG. 4 illustrates a conductor holder for use with the apparatus of the invention.
Figure 5:
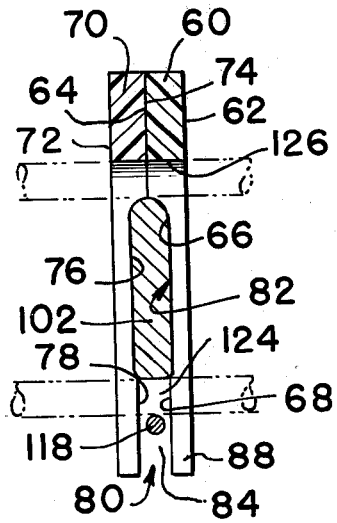
FIG. 5 is a sectional view taken generally along the line V—V of FIG. 4.

Referring to FIGS. 4 and 5, the conductor holder 20 is illustrated in greater detail as comprising a comb structure advantageously formed, such as by molding, from a pair of generally flat members 60 and 70. When in an assembled condition by means of bonding, riveting or the like, the member 60 provides a generally planar upper surface 62 and the member 70 has a similar surface 72. At the joint between these members they are provided with a mirror construction including respective flat surface portions 64, 74, a trough-like surface 66, 76, and a pair of generally flat surfaces 68 and 78. As can be seen in FIG. 5, the surfaces 64 and 74 are mating surfaces while the surfaces 66, 76; 68, 78 are spaced surfaces which define a key-hole shaped slot 80 which extends the length of the conductor holder 20. The slot 80 therefore includes an enlarged portion 82 generally in the center of the holder and a portion 84 which extends laterally of the holder to an outer edge.

The joined members 60 and 70 are provided with a plurality of teeth 86 having conductor receiving spaces 88 therebetween. To hold a plurality of conductors in parallel rows and in an aligned and spaced relationship, the holder 20 is provided with a conductor separation and spacing apparatus 100 which includes an elongate portion 102 for extending between the rows of conductors and through the enlarged slot portion 82 which extends through all of the teeth 86, a pointed nose portion 104 having a detent 106 therein, a handle portion 108 having a hilt 110 for abutting the end of the comb structure, and a slot 112 in the handle 108. A pin 114 extends into the slot 112 and lies within an elongate recessed portion 116 of a wire 118. The wire 118 includes a handle portion 122 for moving the recessed portion longitudinally relative the pin 114 to engage and disengage a hook 120 in the detent 106.

The depth of the slots 88 between the teeth 86 is greater than the required spacing of conductor rows. The teeth 86 are spaced such that the spaces 88 therebetween equal the spacing of the connector channels 17. The transverse dimension of the portion 102 is approximately equal to the spacing of the conductor rows and conductor receiving spaces 124 and 126 are defined by the depth of the slots 88, the transverse dimension of the elongate portion 102 and the clamping effect of the wire 118.

At the start of the termination process, a row of conductors is disposed in the respective comb space portions 126 in accordance with a desired conductor alignment schedule, the member 100 is inserted through the enlarged slot portion 82, the next row of conductors is dressed between the teeth 86 according to the conductor termination schedule and the wire 118 is pivoted into a clamping relationship with the outermost conductors and has its hook 120 releasably engaged within the detent 106. The plurality of conductors, which may be in the form of a cable, is then easily transported from one location to another with the individual conductors disposed in the desired spaced relationship.

With the conductors clamped in the holder 20, the holder 20 is positioned on top of and connected to the front and rear support members 16 and 18 in FIG. 1. Any suitable connection means may be provided for this purpose. In the particular example illustrated in FIG. 1, a pair of undercut members 90, 92 having an L-shaped cross section in each vertical direction are provided to receive the corners of the holder 20 at the front support member 16. A pair of spaced members 94 and 96 are provided on the upper surface of the rear support member for receiving the holder 20 therebetween. Inasmuch as viewed from the right hand side of FIG. 1, the undercut members on the front support member and spaced members on the rear support member are sufficient to align and hold the loaded conductor holder 20 during the insertion operation.

In the overall operation, the conductors are dressed into the holder 20 as previously described. A connector is positioned between the guide members 28 and in abutment with the adjustable screw 30 on the connector support 14 and the conductor support member 16, respectively. The cutting arms 22 are rotated so as to be positioned immediately adjacent and parallel to the connector. Next, the holder 20 carrying the separated and spaced conductors is connected to the front and rear support members 16 and 18 so that the conductors lie parallel the connector channels 17 and are draped over the cutting arms 22. The cutting arms 24 are then rotated to the same positions as the cutting arms 22 thereby severing the conductors to predetermined lengths. The arms 22 and 24 are then rotated to the rear and out of the path of the insertion mechanism parts 26 and 27. Insertion of the conductors is then performed, wherein each insertion member 44, 56 presses a respective conductor into a respective insulation-piercing contact with the operation of the toggle mechanism previously described.

Figure 6:
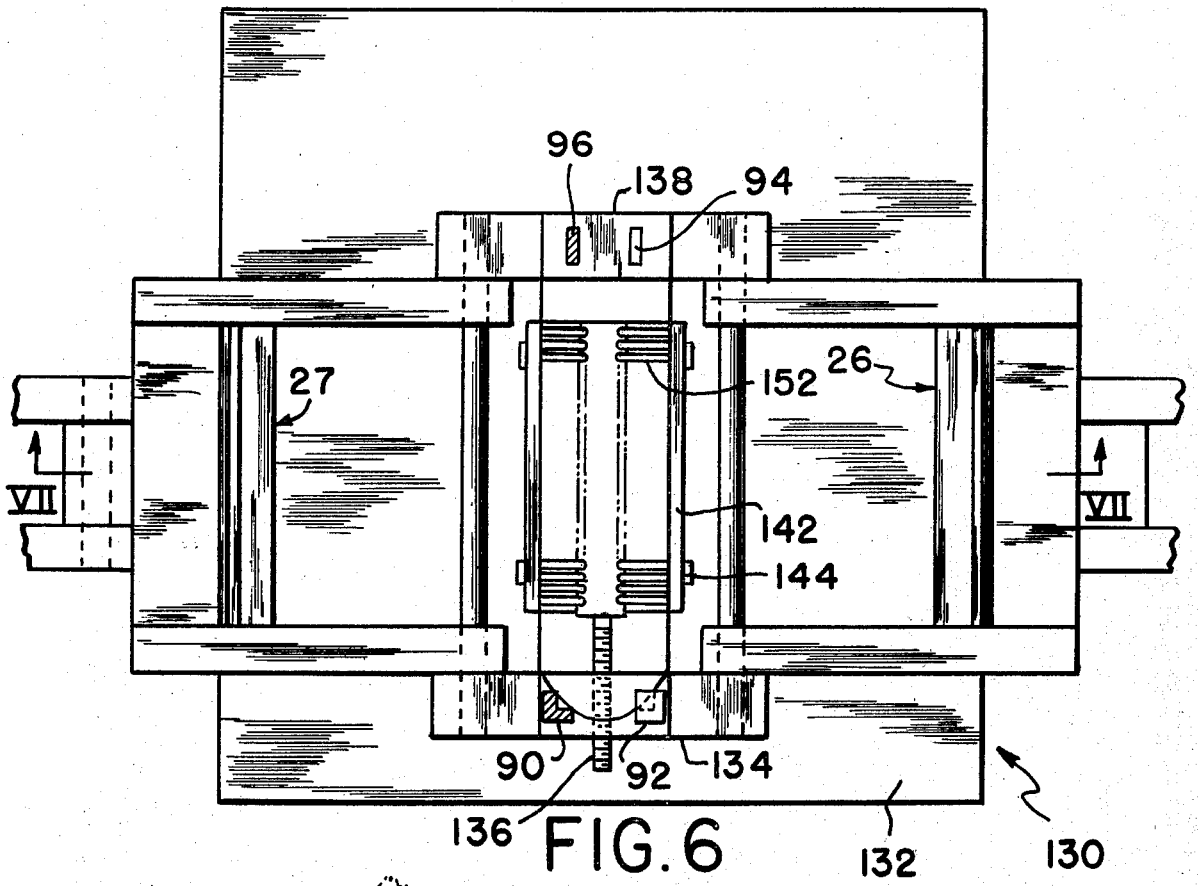
FIG. 6 is a plan view of another embodiment of the invention.
Figure 7:
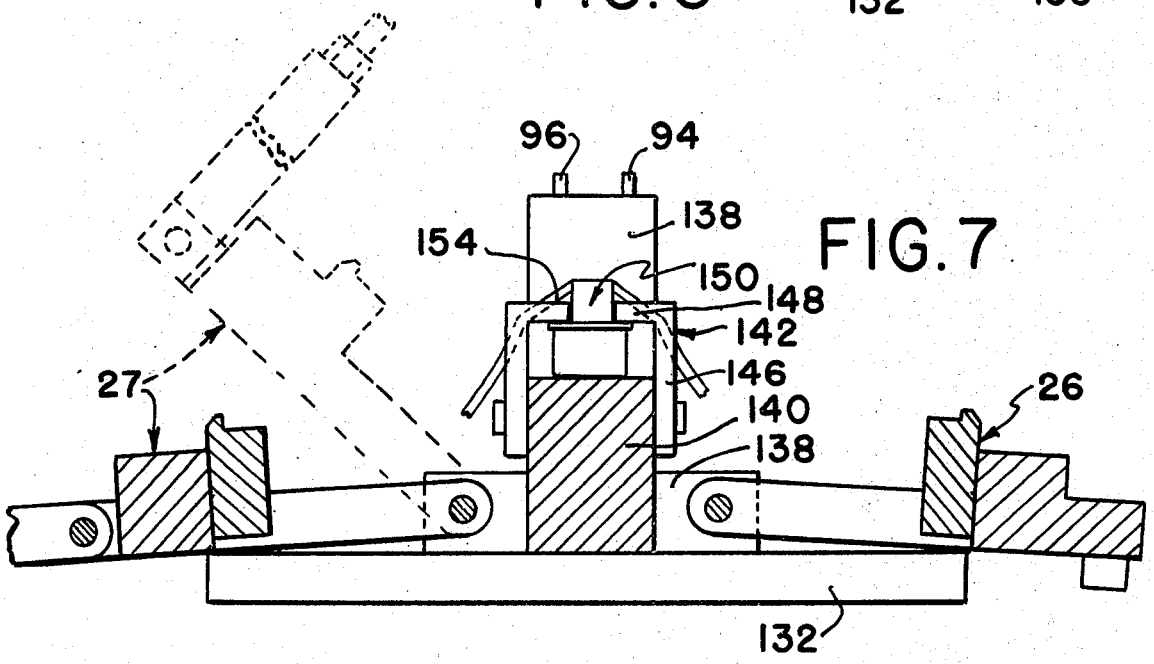
FIG. 7 is a sectional view taken generally along the line VII—VII of FIG. 6.

Referring now to FIGS. 6 and 7, another embodiment of the invention is illustrated wherein a terminator apparatus 130 includes a base 132, front and rear support members mounted on the base 132, a connector support 140 mounted on the base 132 and an insertion mechanism 26, 27 rotatably carried between the front and rear supports 134 and 138.

It is readily apparent that the insertion mechanism and the conductor holder and its connecting mechanism with respect to the front and rear support members 134 and 138 is the same as was described above in reference to FIGS. 1–3. Therefore, this apparatus will not be further discussed.

The front support member 134 includes an adjustable stop screw 136 which functions for adjustably aligning a connector as in the previous embodiment. In this embodiment, however, the connector support 140 is provided with a pair of L-shaped combs which are secured to the support member 140 by machine screws 144 or the like. As can be seen in the drawing, the combs 142 each include a vertical portion 146 and a horizontal portion 148, and the combs are dimensioned and mounted in a spaced relationship to provide a slot 150 therebetween for receiving an electrical connector which is supported on the support member 140. The combs 142 each include a plurality of conductor receiving slots 152 each having a sharp rear edge 154 which functions as a first cutting member.

Figure 8:
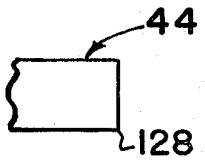
FIG. 8 is a side elevation of an insertion member which may be employed in practicing the present invention.

As in the previous embodiment, the conductor holder is mounted on the front and rear support members 134, 138 and the individual conductors are disposed in a depending relationship adjacent respective contact channels of the electrical connector. In this particular embodiment, rather than extending across a movable cutting arm, the individual conductors dress into the slots 152 which are also aligned with the connector channels. The cutting operation is performed by the individual conductor insertion blades. For example, as illustrated in FIG. 8, a conductor insertion blade 44 includes an edge for engaging and pressing a free-ended conductor into an insulation-piercing contact. For use as a cutting member in cooperation with the cutting edge 154 of a comb slot 152, the insertion blade 44 is provided with a lower sharp edge 130 which effects cutting of a conductor immediately prior to insertion of the same into an insulation-piercing contact as the blade edge 130 traverses an arcuate path past and immediately adjacent the cutting edge 154 of the comb slot.

Figure 9:
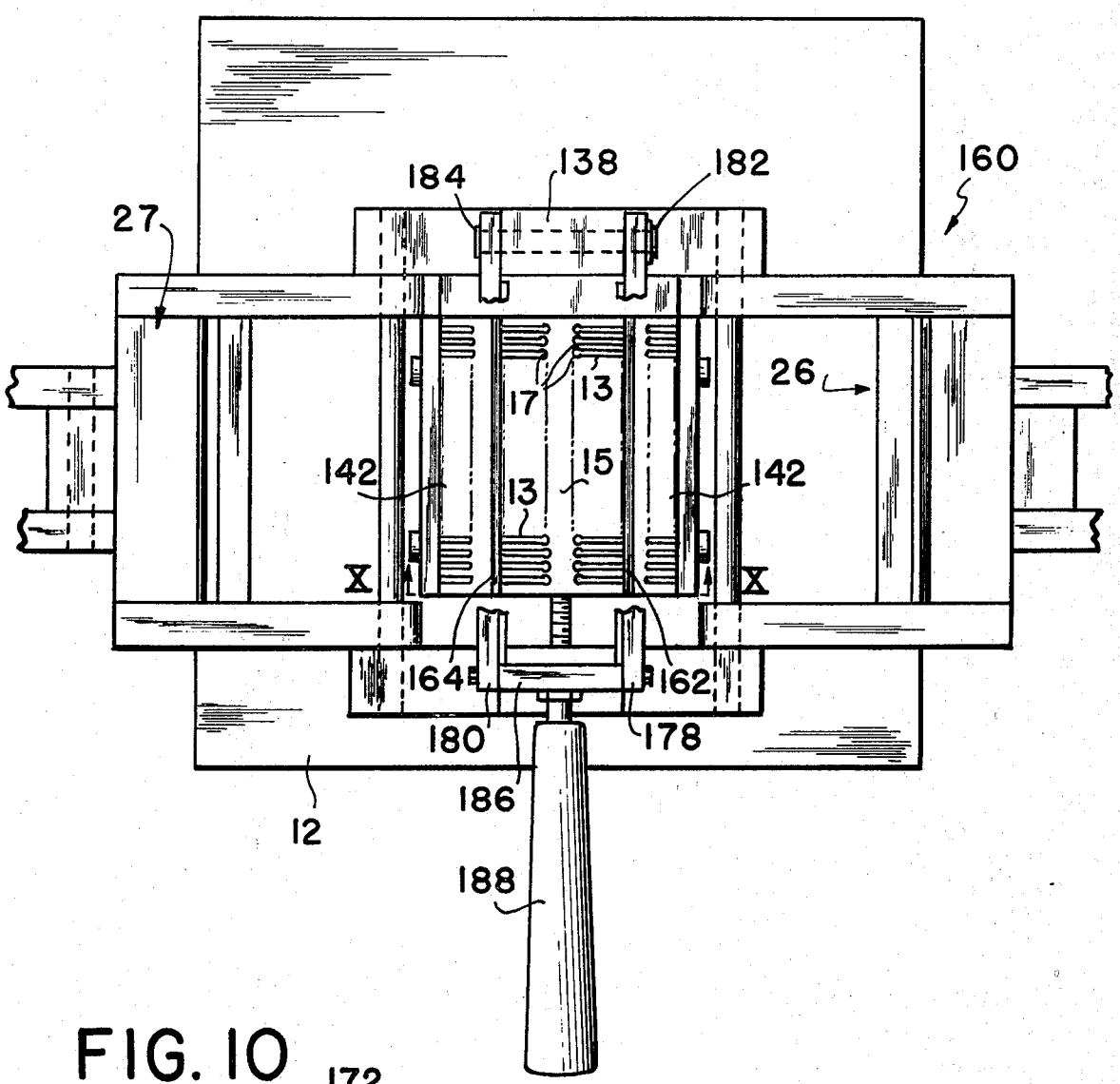
FIG. 9 is a top view of another embodiment of a conductor insertion apparatus having cooperable fixed and rotatable cutting members.
Figure 10:
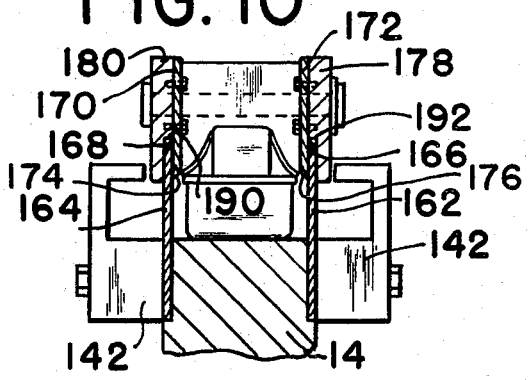
FIG. 10 is a front view, in section, of the apparatus of FIG. 9.
Figure 11:
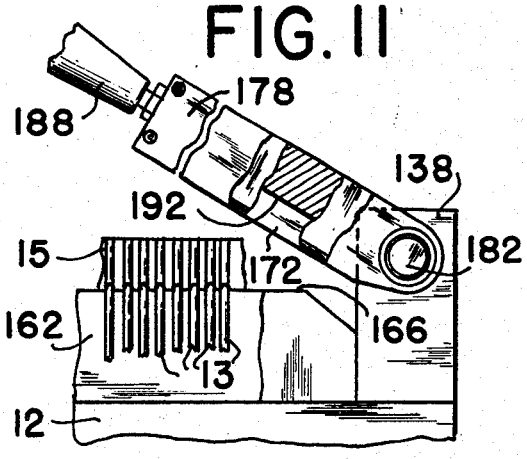
FIG. 11 is a side view, in somewhat of a diagrammatic form, of the cutting members of the apparatus illustrated in FIG. 9.
Figure 12:
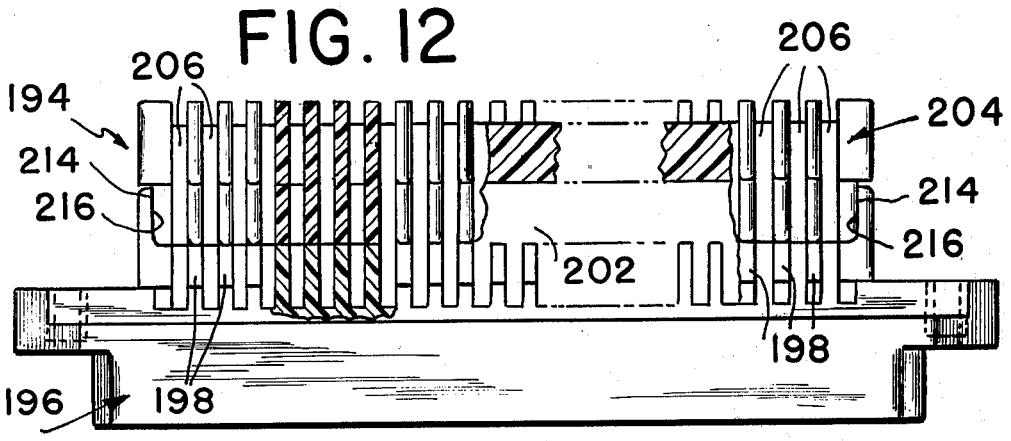
FIG. 12 is an elevational view, partially in section, of an adapter according to the invention, shown mounted on a connector.
Figure 13:
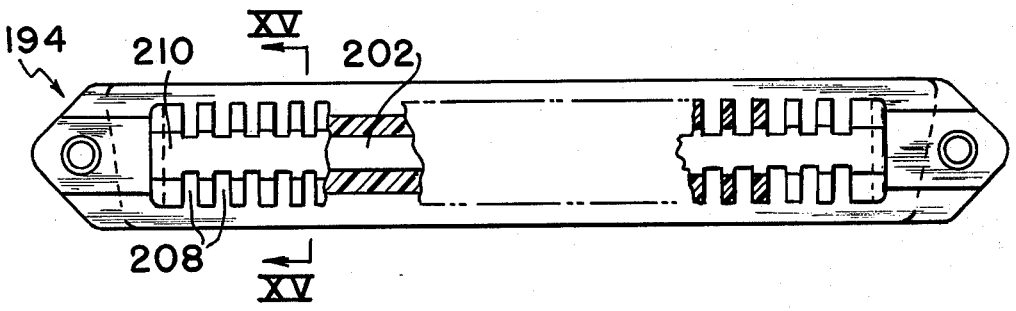
FIG. 13 is a top view of the apparatus of FIG. 12.
Figure 15:
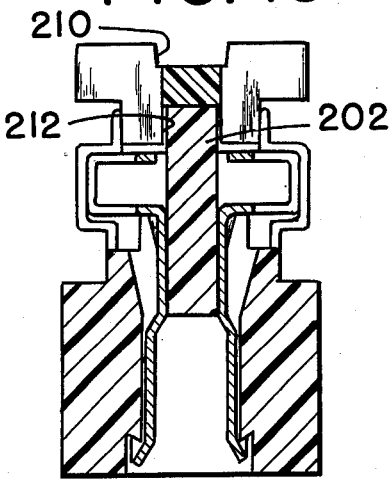
FIG. 15 is a sectional view taken along the line XV—XV of FIG. 13.
Figure 14:
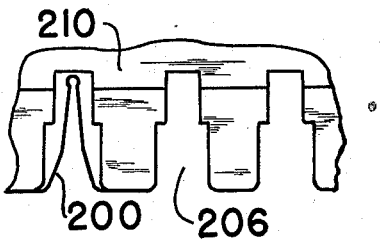
FIG. 14 is a more detailed showing of the channel and contact structure of the connector of FIGS. 12 and 13.

Referring to FIGS. 9, 10 and 11, another embodiment of a terminating apparatus is generally illustrated at 160 as comprising a base 12, a connector support 14 mounted on the base 12, and a pair of cooperable insertion parts 26 and 27 mounted on the base 12 as in the previously described termination apparatus of FIGS. 1–3, 6 and 7. The connector support 14 of the termination apparatus 160 carries a pair of spaced cutting members 162 and 164 having respective cutting edges 166 and 168. The cutting members 162 and 164 receive a connector therebetween and the individual conductors are draped over the cutting edges and through the slots of a pair of combs 142, which may be provided, if desired, as described in connection with FIGS. 6 and 7. The cutting members 162 and 164, are spaced so as to receive therebetween, and respectively adjacent thereto, a cooperable rotatably mounted cutting member.

A pair of cutting members 170 and 172 have respective cutting edges 174 and 176 and are carried on respective members 178 and 180 which are rotatably mounted on the rear support member 138 at 182 and 184 for rotation in a vertical plane and are connected together by a transverse member 186 which carries a handle 188. The cutting members 170 and 172, as can be seen in FIGS. 9–11, rotate in respective planes, which are perpendicular to the plane in which the insertion tools move. The rotatable members 178 and 180 have the inside faces thereof recessed to provide respective shoulders 190 and 192 which engage the upper surfaces of the cutting members 162 and 164 and act as stops.

A cable clamp may be mounted on the rear support 138 so that the cable extends between the rotatable cutting members 170 and 172. In addition, and as in the previously discussed embodiments, mounting apparatus may be provided on the front and rear supports for receiving a conductor holder, such as the holder 20 illustrated in FIG. 4. In addition, a connector adaptor may be utilized with, or in place of, the conductor holder as set forth below.

It is highly desirable for an operator to have flexibility with respect to both termination apparatus and the type of connector which may be served by the termination apparatus. It is therefore advantageous to terminate one type of connector construction with apparatus designed for another type of connector structure, and to be able to perform such termination in a simple and economical manner. In view of this, FIGS. 12–15 illustrate techniques for adapting one type of connector construction for termination by apparatus designed for another type of connector construction.

Referring to FIGS. 12–15, an adapted connector 194 is illustrated as comprising a connector 196 having a construction that is different from the construction of connectors ordinarily terminated by the above-described apparatus and will hereinafter be referred to as a "foreign" connector.

The foreign connector 196 includes a plurality of projections 198 which mount insulation-piercing portions 200 of the electrical contacts therebetween. The connector 196 also includes a projecting ridge 202 which extends substantially the length of the contact mounting part of the connector. A plurality of projections define a plurality of conductor gripping grooves 206 which are aligned with respective ones of the contact portions 200 when the adaptor is mounted on the foreign connector. The grooves 206 extend, at their distal ends, toward an elongate slot 210 and communicate therewith by way of groove extensions 208 which, as will be detailed below, aid in positioning the individual conductors.

The adaptor 204 includes an elongate slot 212 which receives the projection 202 of the foreign connector 196 when the adaptor 204 is mated with the connector. The adaptor 204 also includes surfaces 214 at each end thereof to engage complementary surfaces 216 of the foreign connector 196 and align the grooves and contacts.

The adaptor illustrated in FIGS. 12–15 has, as mentioned above, the primary purpose of adapting a foreign connector to the termination apparatus designed for other connectors and to provide the foreign connector, by means of the gripping grooves 206, with strain relief not heretofore available adjacent the contacts of such a construction. Reflecting for a moment, however, to the holder 20 illustrated in FIG. 4, it is readily apparent that the holder 20 and the adaptor 204 have common features, namely the separation and holding of the conductors in a predetermined, spaced relationship in accordance with the spacing of the connector contacts. Therefore, it is readily apparent that the adaptor 204 may also be dressed at a separate, remote station and the conductors held thereby transported to the work station in a spaced relationship.

In view of the above-described structures, the present invention exhibits a variety of techniques for terminating electrical connectors. The methods for terminating connectors may include the utilization of a holder, such as the holder 20, to position separated conductors adjacent respective insulation-piercing portions of contacts and their associated strain relief groove structure, whether such groove structure is constituted as part of a connector or as part of a foreign connector adapted for termination by apparatus such as disclosed herein. The adaptor itself, however, may be utilized in the same manner as the conductor holder of FIG. 4; however, instead of mounting such a holder on the termination apparatus, the adaptor engages and becomes a part of the foreign connector.

Because of all of the various possibilities for terminating conductors, several basic methods of termination, some of which have been set forth above, become evident to those skilled in the art. Some of these methods are set forth below in the following examples.

First of all, the holder 20 may be utilized with each of the termination apparatus disclosed herein. Depending on the particular connector, it may or may not be necessary to dress the individual conductors into the distal ends of the channel grooves prior to insertion. Also, depending on which type of cutting mechanism is used, the conductors may be cut to length at various stages during the termination procedure. For example, the apparatus of FIGS. 1 and 2 provide for cutting, if the conductors have not been previously cut, as a separate step prior to insertion. On the other hand, the apparatus illustrated in FIGS. 6 and 7 provide conductor cutting contemporaneously during the insertion operation. The apparatus of FIGS. 9 and 10, again provide for conductor cutting as a separate step prior to insertion.

The conductors may be cut by a separate mechanism, prior to receipt thereof at the work station, particularly when a holder or adaptor is utilized. The cutting operation may be performed before or after the conductors are placed in a holder or adaptor, depending on which procedure is most advantageous in the overall termination procedure.

Two of the methods disclosed herein, and the apparatus attendant thereto, may be combined to advantage in some instances to form a composite method. For example, the conductors may be dressed into a holder and cut to length at a first station and transported to a second station where the holder is mounted over a foreign connector having an adaptor applied thereto. The individual conductors, may then be dressed into the adaptor, in situations requiring such a step, before the conductors are inserted into the respective aligned grooves and insulation-piercing contact portions.

In view of the foregoing, it is readily apparent that the provision of different configurations of terminating apparatus, conductor holders and/or connector adaptors, provides a great deal of flexibility for an operator in terminating free-ended insulated conductors in electrical connectors, particularly where a large number of conductors are involved and the termination process is a field operation.

Certain modifications of the termination apparatus discussed above has proven advantageous in certain application. For example, in applications where there is concern with respect to clearance between the insertion parts 26 and 27 and the respective stationary cutting members 162 and 164, the stationary cutting members may be constructed to rotate to and away from the cutting position. In this type of construction, the stationary cutting members are provided with upwardly extending ears which are rotatably connected at 182 and 184. The forward ends of the members 178 and 180 carry respective spring latches, each of which is mounted in a yieldable interference relationship with the forward ends of the respective other cutting members so as to engage the respective ends and pivot those cutting members clear of the insertion parts after a cutting operation. Each of the springs may include a first portion for connection to the respective rotatable member, a second portion perpendicular thereto for embracing the outer free end of the cooperable and now rotatable cutting member, a third portion perpendicular to the second portion and parallel to the first portion for engaging the lower edge of the cooperable cutting member when it is in the cutting position, and a fourth and inclined portion which is cammed by the end of the cooperable cutting member as the rotatable members are rotated downwardly to perform the cutting operation. As the junction of the third and fourth portions pass the lower edge of the forward end of the cooperable cutting member, the spring embraces the end of the cooperable cutting member and carries it in the opposite direction as the handle is rotated upwardly.

Although the invention has been described by reference to particular illustrative embodiments thereof, many other changes and modifications of the invention may become apparent to those skilled in the art without departing from the spirit and scope of the invention. It is therefore intended to include within the patent warranted hereon all such changes and modifications as may reasonably and properly be included within the scope of this contribution to the art.

I claim:

1. Apparatus for terminating a plurality of insulated conductors in respective insulation-piercing contact portions supported by an electrical connector, said apparatus comprising:

first support means for supporting the electrical connector;

a movably mounted first cutter member for disposition adjacent and parallel to the supported connector;

second support means for supporting the conductors adjacent respective contact portions and to extend across said first cutter member;

a movably mounted second cutter member cooperable with said first cutter member to cut the conductors at a predetermined distance from the respective insulation-piercing contact portions; and a movably mounted insertion tool including a plurality of insertion blades aligned with the contact portions for engaging and pressing the conductors into the insulation-piercing contact portions.

2. The apparatus of claim 1, wherein said second support means comprises:

a body including a toothed edge for receiving conductors between the teeth thereof;

means carried within said body for limiting the depth of conductor placement between the teeth; and holding means extending along said body to retain the conductors therein.

3. The apparatus of claim 1, wherein said first and second cutter members are pivotally mounted for movement about the same axis.

4. The apparatus of claim 1, wherein said insertion tool comprises:

a base;

a first member carrying some of said insertion blades and pivotally mounted on said base and pivotal to engage the conductors;

a second member carrying others of said insertion blades and pivotally mounted on said base to sandwich the connector and conductors between said first and second members; and means for moving said first and second members toward each other to press the conductors into the insulation-piercing contacts.

5. The apparatus of claim 4, wherein the last mentioned means includes a toggle linkage carried on one of said members and comprising means for embracing at least a portion of the other of said members including a lever pivotal to shorten the effective length of said linkage.

6. Apparatus for terminating a plurality of insulated conductors in respective insulation-piercing contact portions supported on opposite sides of an electrical connector, said apparatus comprising:

first support means for supporting the electrical connector;

a pair of movable first cutter members for disposition adjacent and parallel to the supported connector;

second support means for supporting the conductors adjacent respective contact portions and to extend across the first cutter members;

a pair of movable second cutter members cooperable with respective ones of said first cutter members to cut the conductors at a predetermined distance from the respective insulation-piercing contact portions;

a plurality of insertion blades pivotally mounted on respective sides of the supported connector and in alignment with respective contact portions for engaging the supported conductors; and means for rotating said insertion blades to engage and press the conductors into their respective insulation-piercing contact portions.

7. Apparatus for terminating a plurality of insulated conductors in respective insulation-piercing portions of contacts supported by an electrical connector, said apparatus comprising:

first support means for supporting the electrical connector with the contact portions oriented gernally vertical;

a movably mounted first conductor cutting member for positioning adjacent the connector support means and a connector mounted therein;

second support means for supporting the plurality of conductors to depend adjacent the contact portions and to extend across said first cutting member;

a movably mounted second conductor cutting member cooperable with said first cutting member to cut the conductors at a predetermined distance from their respective insulation-piercing contact portions; and means for engaging and simultaneously inserting the conductors into their respective insulation-piercing contact portions including a plurality of insertion members each of which engages and presses a conductor into a respective insulation-piercing contact portion.

8. Apparatus for terminating a plurality of insulated conductors in respective insulation-piercing contact portions of an electrical connector, comprising:

a connector support for mounting the electrical connector;

first conductor cutting member mounted parallel to and spaced from said connector support;

a conductor support mounted parallel to said connector support for supporting and aligning the conductors to extend adjacent respective connector contact portions and to extend over said first cutting member;

a rotatably mounted second conductor cutting member cooperable with said first cutting member to cut the conductors at respective points spaced from said connector support; and an insertion tool movably mounted with respect to said connector support for movement in a plane perpendicular to the plane of rotation of said second cutting member and including a plurality of insertion blades aligned with respective ones of the contact portions for engaging and pressing the conductors into respective insulation-piercing contact portions.

9. Apparatus for terminating a plurality of insulated conductors in respective insulation-piercing contact portions of an electrical connector, comprising:

a connector support for mounting the electrical connectors;

a first conductor cutting member mounted parallel to and spaced from said connector support;

a conductor support mounted parallel to said connector support for supporting and aligning the conductors to extend adjacent respective connector contact portions and to extend over said first cutting member;

a rotatably mounted second conductor cutting member cooperable with said first cutting member to cut the conductors at respective points spaced from said connector support;

an insertion tool movably mounted with respect to said connector support and including a plurality of insertion blades aligned with respective ones of the contact portions for engaging and pressing the conductors into respective insulation-piercing contact portions;

the conductors being supported on opposite sides of the conductor support, said apparatus further comprising a third conductor cutting member mounted parallel to and spaced from the side of said connector support opposite to that of said first cutting member;

a fourth conductor cutting member mounted spaced from and rotatable with said second conductor cutting member, said second and fourth cutting members connected together and rotatable in spaced planes, said fourth cutting member cooperable with said third cutting member to cut the conductors on the opposite side of said connector support; and said insertion tool comprising insertion blades on each side of said connector support for engaging and pressing the cut conductors into the insulation-piercing contact portions on each side of the connector.

10. Apparatus for installing a plurality of conductors in conductor receiving portions of contacts which are mounted in an electrical connector, comprising:

first support means for supporting the electrical connector;

a rotatably mounted first cutter member for disposition adjacent and parallel to the supported connector;

second support means for supporting the conductors adjacent the conductor receiving portion of the contacts and extending across said first cutter member;

a second cutter member mounted for rotation about the same axis as said first cutter member and cooperable therewith to cut the conductors at a predetermined distance from the conductor receiving portions of the contacts; and a movably mounted installation tool including a plurality of installation members aligned with the conductor receiving portions for engaging and forcing the conductors into mechanical and electrical contact with said conductor receiving portions.

11. The installation apparatus according to claim 10, wherein said second cutter members includes means for engaging said first cutting member upon completion of cutting and rotatably carrying said first cutter member with said second cutter member during rotation of said second cutter member in a direction opposite to that rotated during cutting.

12. Apparatus for terminating a plurality of insulated conductors in respective insulation-piercing contact portions of an electrical connector, comprising:

a connector support for mounting the electrical connector;

a first conductor cutting member mounted parallel to and spaced from said connector support;

a conductor support mounted parallel to said connector support for supporting and aligning the conductors to extend adjacent respective connector contact portions and to extend over said first cutting member;

a rotatably mounted second conduct or cutting member cooperable with said first cutting member to cut the conductors at respective points spaced from said connector support;

an insertion tool movably mounted with respect to said connector support and including a plurality of insertion blades aligned with respective ones of the contact portions for engaging and pressing the conductors into respective insulation-piercing contact portions;

said first conductor cutting member fixed to said connector support and including a cutting edge; and said rotatably mounted cutting member including a cutting edge which is cooperable with the cutting edge of said first conductor cutting member, said rotatable cutting member, mounted for rotation through a plane perpendicular to the plane in which said insertion tool moves.

* * * * *